US008857224B2

(12) United States Patent
Kim et al.

(10) Patent No.: US 8,857,224 B2
(45) Date of Patent: Oct. 14, 2014

(54) WASHING MACHINE HAVING BALANCER AND METHOD OF MANUFACTURING BALANCER THEREOF

(75) Inventors: Ja Young Kim, Suwon-si (KR); Ito Michiaki, Suwon-si (KR); Doo Young Ryu, Suwon-si (KR); Myung Sun Kang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 471 days.

(21) Appl. No.: 11/806,246

(22) Filed: May 30, 2007

(65) Prior Publication Data

US 2007/0283727 A1 Dec. 13, 2007

(30) Foreign Application Priority Data

Jun. 1, 2006 (KR) ..... 10-2006-0049477
Jun. 1, 2006 (KR) ..... 10-2006-0049481

(51) Int. Cl.
*D06F 37/22* (2006.01)

(52) U.S. Cl.
CPC ..... *D06F 37/225* (2013.01)
USPC ..... 68/23.2; 68/24

(58) Field of Classification Search
CPC ..... D06F 37/225; D06F 2222/00
USPC ..... 68/24, 58, 23.2, 23.3; 74/572.4, 570.2
See application file for complete search history.

(56) References Cited

U.S. PATENT DOCUMENTS 2,653,483 A * 9/1953 Smith ..... 68/23.2
2,836,993 A * 6/1958 Johnson et al. ..... 74/665 F
2,984,094 A * 5/1961 Belaieff ..... 68/23.2
3,166,356 A * 1/1965 Sutherland et al. ..... 301/5.22
3,191,997 A * 6/1965 Colvert ..... 301/5.22
3,321,997 A * 5/1967 Peterson ..... 74/570.2
3,346,303 A * 10/1967 Wesley ..... 301/5.22
3,462,198 A * 8/1969 Onufer ..... 301/5.22
3,494,471 A * 2/1970 Grippo ..... 210/363
3,733,923 A * 5/1973 Goodrich et al. ..... 74/570.2
4,388,841 A * 6/1983 Gamble ..... 74/572.4

(Continued)

FOREIGN PATENT DOCUMENTS

EP 0 810 389 3/1997
JP 2001-276473 * 10/2001

(Continued)

OTHER PUBLICATIONS

European Search Report for corresponding European Application 07 10 9106-2314; mailed Aug. 4, 2008.

*Primary Examiner* — Joseph L Perrin
(74) *Attorney, Agent, or Firm* — Staas & Halsey LLP

(57) ABSTRACT

A washing machine is provided having at least one balancer and a method of manufacturing a balancer thereof is further provided, the method and machine capable of reducing a manufacturing cost and an assembly time, and allowing the balancer assembled to a spin tub to be easily replaced with a new balancer. The balancer applied to the washing machine and the method of manufacturing the balancer of the washing machine are adapted such that a pipe is formed in an annular shape and is assembled to a spin tub, so that a manufacturing cost and an assembly time can be reduced to improve mass productivity. Further, when the balancer is determined to fail after being assembled to the spin tub, the balancer can be rapidly and conveniently replaced with a new balancer, so that material costs can be reduced.

13 Claims, 12 Drawing Sheets

(56) References Cited

U.S. PATENT DOCUMENTS

| | | | | | |
|---|---|---|---|---|---|
| 4,433,592 | A | * | 2/1984 | Tatsumi et al. | 74/570.2 |
| 4,646,545 | A | * | 3/1987 | Fanson et al. | 68/23.2 |
| 4,653,169 | A | * | 3/1987 | Puszakowski | 29/445 |
| 5,142,936 | A | * | 9/1992 | McGale | 74/570.2 |
| 5,419,164 | A | * | 5/1995 | Durazzani | 68/23.2 |
| 5,513,504 | A | * | 5/1996 | Sribar et al. | 68/23.3 |
| 5,746,069 | A | * | 5/1998 | Kim | 68/23.2 |
| 5,782,110 | A | * | 7/1998 | Kim | 68/23.3 |
| 5,802,885 | A | * | 9/1998 | Kim | 68/23.2 |
| 5,850,748 | A | * | 12/1998 | Kim et al. | 68/23.2 |
| 5,850,749 | A | | 12/1998 | Kim | |
| 5,857,360 | A | | 1/1999 | Kim et al. | |
| 5,857,361 | A | * | 1/1999 | Jang | 68/23.2 |
| 5,870,908 | A | * | 2/1999 | Rushlow | 68/23.2 |
| 6,119,547 | A | * | 9/2000 | Goransson et al. | 74/572.4 |
| 6,122,843 | A | | 9/2000 | Noguchi et al. | |
| 6,439,003 | B1 | * | 8/2002 | Uhlin | 68/23.2 |
| 6,442,782 | B1 | | 9/2002 | Vande Haar | |
| 6,658,902 | B2 | | 12/2003 | Southworth | |
| 6,741,544 | B1 | | 5/2004 | Masaki et al. | |
| 6,782,722 | B2 | * | 8/2004 | Yokoi et al. | 68/12.06 |
| 7,134,731 | B2 | * | 11/2006 | Fogal et al. | 301/5.22 |
| 2005/0274159 | A1 | | 12/2005 | Jeon et al. | |

FOREIGN PATENT DOCUMENTS

| | | | |
|---|---|---|---|
| JP | 2001-321592 | * | 11/2001 |
| JP | 2005-304715 | * | 11/2005 |
| KR | 10-1998-067153 | | 10/1998 |
| KR | 20-0134130 | | 4/1999 |
| KR | 10-1999-0038279 | | 6/1999 |
| SU | 1461796 | | 2/1989 |
| WO | WO 99/50495 | | 10/1999 |

* cited by examiner

WASHING MACHINE HAVING BALANCER AND METHOD OF MANUFACTURING BALANCER THEREOF

CROSS-REFERENCE TO RELATED APPLICATIONS

This application claims the benefit of Korean Patent Application No. 2006-49481, filed Jun. 1, 2006, and the benefit of Korean Patent Application No. 2006-49477, filed on Jun. 1, 2006, in the Korean Intellectual Property Office, the disclosures of which are incorporated herein by reference.

BACKGROUND OF THE INVENTION

1. Field of the Invention

The present invention relates generally to a washing machine having at least one balancer, and more particularly to a washing machine having at least one balancer capable of reducing a manufacturing cost and an assembly time, and allowing the balancer assembled to a spin tub to be easily replaced.

2. Description of the Related Art

In general, washing machines do the laundry by spinning a spin tub containing the laundry by driving the spin tub with a driving motor. In a washing process, the spin tub is spun forward and backward at a low speed. In a dehydrating process, the spin tub is spun in one direction at a high speed.

When the spin tub is spun at a high speed in the dehydrating process, if the laundry leans to one side without uniform distribution in the spin tub or if the laundry leans to one side due to the abrupt acceleration of the spin tub in an early stage of the dehydrating process, the spin tub undergoes a deviation between the center of gravity and the center of rotation to thus cause noise and vibration. The repetition of this phenomenon causes parts, such as a spin tub and its rotating shaft, a driving motor, etc., to break or causes a reduction in the life span of the parts.

Particularly, a drum type washing machine has a structure in which the spin tub containing laundry is horizontally disposed, the spin tub is spun at a high speed in the state where laundry is collected on the bottom of the spin tub by gravity in the dehydrating process, so that the spin tub undergoes a deviation between the center of gravity and the center of rotation to have a high possibility of causing excess noise and vibration.

Thus, the drum type washing machine is typically provided with at least one balancer for maintaining a dynamic balance of the spin tub. The balancer is equally applied to an upright type washing machine in which the spin tub is vertically installed.

An example of a washing machine having ball balancers is disclosed in Korean Patent Publication No. 1999-0038279. The ball balancers of a conventional washing machine include racers installed on the top and the bottom of a spin tub in order to maintain a dynamic balance when the spin tub is spun at a high speed, and steel balls and viscous oil are disposed and freely move in the racers.

Thus, when the spin tub is spun without maintaining a dynamic balance due to an unbalanced eccentric structure of the spin tub itself and a lopsided distribution of the laundry in the spin tub, the steel balls compensates for this unbalance, and thus the spin tub can maintain the dynamic balance.

However, the conventional washing machine has a structure in which an entire circumferential edge of each ball balancer is seam-welded to the spin tub, so that the spin tub forms part of the surface of each ball balancer, or a structure in which each ball balancer includes upper and lower plates fused to each other, thereby requiring a high manufacturing cost and long assembly time, which lowers mass productivity.

Further, the conventional washing machine has a structure in which each ball balancer coupled to the spin tub cannot be replaced with a new one, thus necessitating discarding the entire spin tub when any ball balancer is determined to be a failure in a quality inspection.

In addition, each ball balancer of the conventional washing machine has an irregularly stepped structure because fusion scraps are generated around a long fusion portion (or a long seam portion) formed along a path of motion of balls during fusion, so that the balls generate unnecessary noise and vibration while moving along the fusion portion.

SUMMARY OF THE INVENTION

Accordingly, the present invention has been made to solve the above-mentioned problems occurring in the prior art, and an object of the present invention is to provide a washing machine having at least one balancer that is capable of reducing a manufacturing cost and an assembly time, and allowing the balancer assembled to a spin tub to be replaced with a new balancer.

Another object of the present invention is to provide a method of manufacturing a balancer of a washing machine, the method being capable of reducing manufacturing time and cost and minimizing generation of a height difference between opposite ends of the balancer and generation of weld beads along the balancer.

Additional aspects and/or advantages of the invention will be set forth in part in the description which follows and, in part, will be apparent from the description, or may be learned by practice of the invention.

The foregoing and/or other aspects of the present invention can be achieved by providing a washing machine having a spin tub and at least one balancer. The balancer is manufactured by forming a pipe to have an annular shape.

Here, the spin tube may include an annular recess corresponding to the balancer such that the balancer is coupled to the spin tub.

Further, the balancer may be welded in the annular recess at several points in the recess.

Further, the balancer may include a plurality of balls within an internal space of the balancer and moving within the internal space of the balancer and a viscous fluid that moves within the internal space.

Further, the balancer may be manufactured in such a manner that opposite, open ends of the pipe are in contact with each other, and then are welded to each other.

Meanwhile, the washing machine may be a drum type washing machine, and the front end and the rear end of the spin tub include a front member and a rear member, respectively. The at least one balancer includes a plurality of balancers coupled to the front member and the rear member. The recesses may be provided at the front and rear members of the spin tub such that the balancers are coupled to opposite ends of the spin tub.

Further, the balancer may have a circular cross section or may have a quadrilateral cross section. One side of the balancer having a quadrilateral cross section may be curved. Corners of the balancer having a quadrilateral cross section may be rounded.

Further, the balancer may have a cross section of a square, one side of which is curved.

Further, the balancer may have a cross section of a square, all corners of which are rounded.

The foregoing and/or other aspects of the present invention can be achieved by providing a method of manufacturing a balancer of a washing machine having a spin tub. The method includes bending a linear pipe into an annular shape corresponding to an outer circumferential end of the spin tub, welding opposite ends of the bent pipe to form an annular pipe to have a circular cross section, and removably fitting the bent linear pipe into a recess provided at the outer circumferential end of the spin tub.

Here, the method may further include forming the annular pipe having a circular cross section into an annular pipe having a quadrilateral cross section.

Further, the method may further include putting a plurality of balls and a viscous fluid into the pipe before the forming the annular pipe to have a circular cross section.

Further, the method may further include curving at least one side of an annular pipe having a quadrilateral cross section after forming the annular pipe having a circular cross section into an annular pipe having a quadrilateral cross section.

Further, the method may further include rounding all corners of the annular pipe having a quadrilateral cross section after the forming the annular pipe having a circular cross section into an annular pipe having a quadrilateral cross section.

In addition, the forming the annular pipe having a circular cross section into an annular pipe having a quadrilateral cross section may be performed by pressing the annular pipe having a circular cross section.

BRIEF DESCRIPTION OF THE DRAWINGS

The above and other aspects and advantages of the present invention will be more apparent and more readily appreciated from the following detailed description of the embodiments, taken in conjunction with the accompanying drawings, in which.

DETAILED DESCRIPTION OF THE PREFERRED EMBODIMENTS

Figure 1:
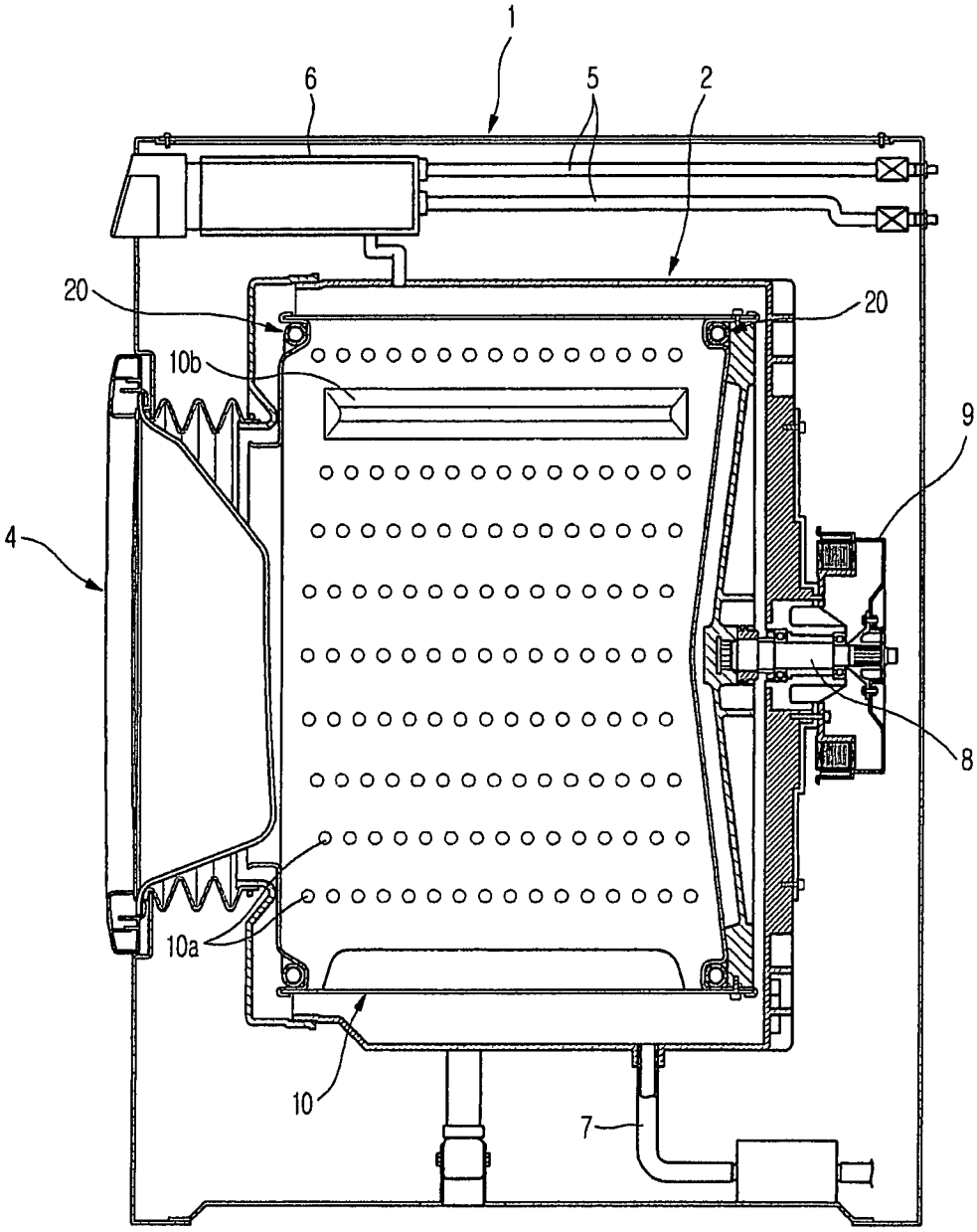
FIG. 1 is a sectional view illustrating the schematic structure of a washing machine according to the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Hereinafter, exemplary embodiments of the present invention will be described with reference to the attached drawings.

FIG. 1 is a sectional view illustrating the schematic structure of a washing machine according to the present invention.

As illustrated in FIG. 1, a washing machine according to the present invention includes a housing 1 forming an external structure of the washing machine, a water reservoir 2 installed in the housing 1 and containing washing water, a spin tub 10 disposed rotatably in the water reservoir 2, which allows laundry to be placed within and washed therein, and a door 4 hinged to an open front of the housing 1.

Feed pipes 5 and a detergent feeder 6 are disposed above the water reservoir 2 in order to supply washing water and detergent to the water reservoir 2, and a drain pipe 7 installed therebelow in order to drain the washing water contained in the water reservoir 2 to the outside of the housing 1 when the laundry is completely done.

The spin tub 10 has a rotary shaft 8 disposed at the rear thereof so as to extend through the rear of the water reservoir 2, and a driving motor 9, with which the rotary shaft 8 is coupled, installed on a rear outer side thereof. Therefore, when the driving motor 9 is driven, the rotary shaft 8 is rotated together with the spin tub 10.

The spin tub 10 is provided with a plurality of dehydrating holes 10*a* at a periphery thereof to allow the water contained in the water reservoir 2 to flow into the spin tub 10 together with the detergent to wash the laundry in a washing cycle, and to allow the water to be drained to the outside of the housing 1 through a drain pipe 7 in a dehydrating cycle.

The spin tub 10 has a plurality of lifters 10*b* disposed longitudinally therein. Therefore, as the spin tub 10 rotates at a low speed in the washing cycle, the laundry submerged in the water is raised up from the bottom of the spin tub 10 and then is lowered to the bottom of the spin tub 10, so that the laundry can be effectively washed.

Thus, in the washing cycle, the rotary shaft 8 alternately rotates forward and backward due to the driving motor 9 to spin the spin tub 10 at a low speed, so that the laundry is washed. In the dehydrating cycle, the rotary shaft 8 rotates in one direction to spin the spin tub 10 at a high speed, so that the laundry is dehydrated.

When spun at a high speed in the dehydrating cycle, the spin tub 10 may undergo a deviation between the center of gravity and the center of rotation of the spin tub 10, or the laundry may lean to one side without uniform distribution in the spin tub 10. In this case, the spin tub 10 does not maintain a dynamic balance.

In order to prevent this dynamic unbalance to allow the spin tub 10 to be spun at a high speed with the center of gravity and the center of rotation thereof matched with each other, the spin tub 10 is provided with balancers 20 according to a first or second embodiment of the present invention at front and rear ends thereof. The structure of the balancers 20 according to first and second embodiments of the present invention will be described with reference to FIGS. 2 through 6.

Figure 2:
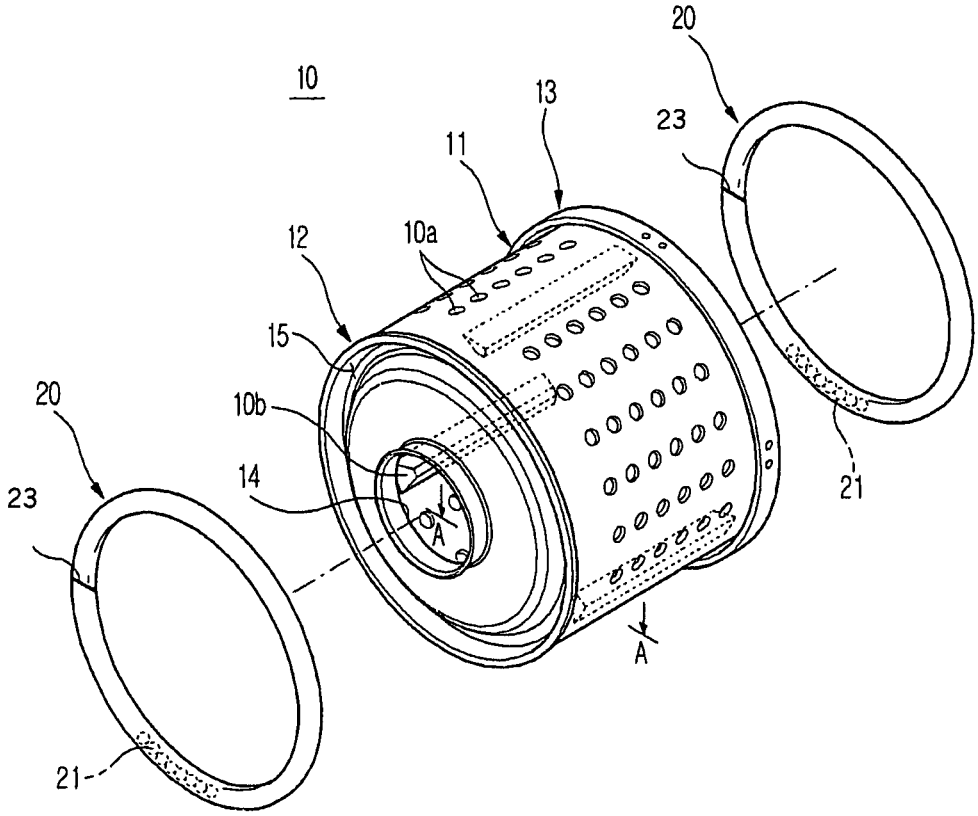
FIG. 2 is a perspective view illustrating balancers according to a first embodiment of the present invention, in which the balancers are disassembled from a spin tub.

FIG. 2 is a perspective view illustrating balancers according to the embodiment of the present invention, in which the balancers are disassembled from a spin tub.

As illustrated in FIG. 2, the spin tub 10 includes a cylindrical body 11 that has open front and rear ends and is provided with the dehydrating holes 10*a* and lifters 10*b*, a front member 12 that is coupled to the open front end of the body 11 and is provided with an opening 14 permitting the laundry to be placed in or removed from the body 11, and a rear member 13 that is coupled to the open rear end of the body 11 and with the rotary shaft 8 for spinning the spin tub 10.

The front member 12 is provided, at an edge thereof, with an annular recess 15 that has the cross section of an approximately "C" shape and is open to the front of the front member 12 in order to hold any one of the balancers 20. Similarly, the rear member 13 is provided, at an edge thereof, with an annular recess 15 (not shown) that is open to the rear of the rear member 13 in order to hold the other of the balancers 20. The annular recess may be provided along an outer circumferential edge of front or rear ends of the spin tub 10.

The front and rear members 12 and 13 are fitted into and coupled to the front or rear edges of the body 11 in a screwed fashion or in any other manner that allows the front and rear members 12 and 13 to be attached to the body 11. Alternatively, the front and rear members 12 and 13 may be integrally affixed to the body 11 of the spin tub 10.

Each balancer 20 is manufactured by forming a linear pipe of a metal, such as a stainless steel, in an annular shape so the balancer 20 is able to be fitted into each recess 15 of the spin tub 10. Then opposite ends of the annular pipe which are in contact with each other are welded together at a joint 23.

When each balancer 20 is manufactured using the metal pipe in this manner, each balancer 20 can be manufactured and assembled in a rapid and convenient way, and each balancer 20 has a completely closed structure. As a result, each balancer 20 can be coupled to the spin tub 10 without forming one surface of the spin tub.

Each balancer 20 of the present invention includes a plurality of metal balls 21 filled in the annular pipe having a closed internal space to perform a balancing function, and a viscous fluid (not shown) capable of adjusting a speed of motion of the balls 21. The balls 21 and the viscous fluid are filled in the metal pipe before the opposite ends of the metal pipe are connected to each other and welded together.

The annular balancers 20 manufactured as described above are disposed in the annular recesses 15 provided to the front and rear members 12 and 13 of the spin tub 10, and are welded in the recesses 15 at several points, so that the balancers 20 may be rapidly and conveniently assembled.

As such, if any balancer 20 is determined to fail because the balancer 20 does not fulfill its function after the balancer 20 is assembled to the front or rear member of the spin tub 10, the balancer 20 can be rapidly and conveniently disassembled from the spin tub 10, and then be replaced with a new one.

Figure 3:
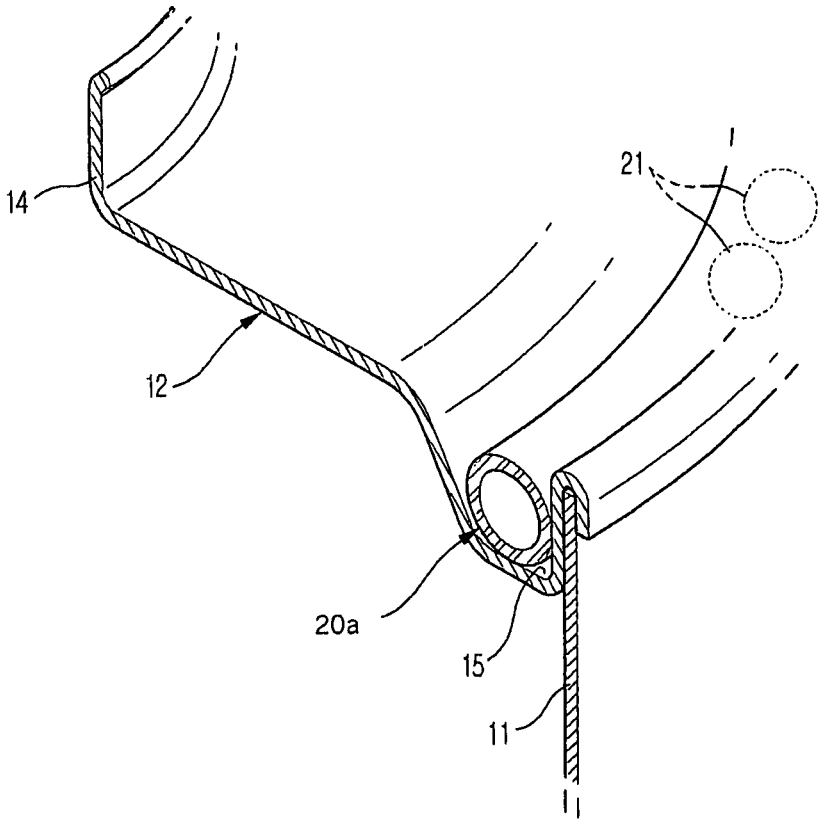
FIG. 3 is a sectional view taken along line A-A of FIG. 2 of the balancer according to the first embodiment of the present invention.
Figure 4:
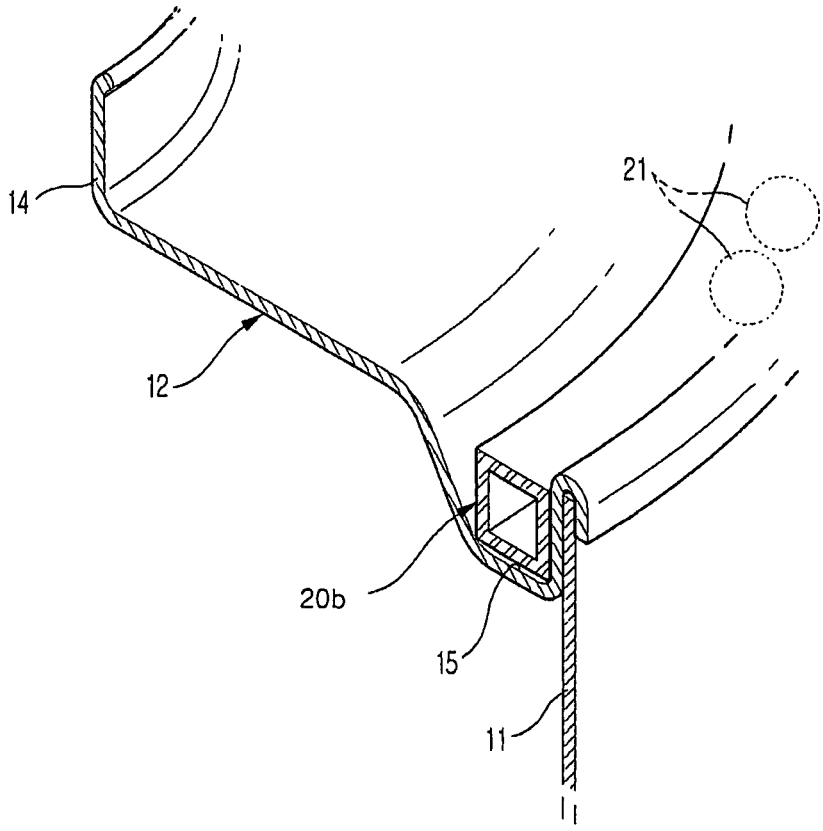
FIG. 4 is a sectional view taken along line A-A of FIG. 2 of the balancer according to the second embodiment of the present invention.
Figure 5:
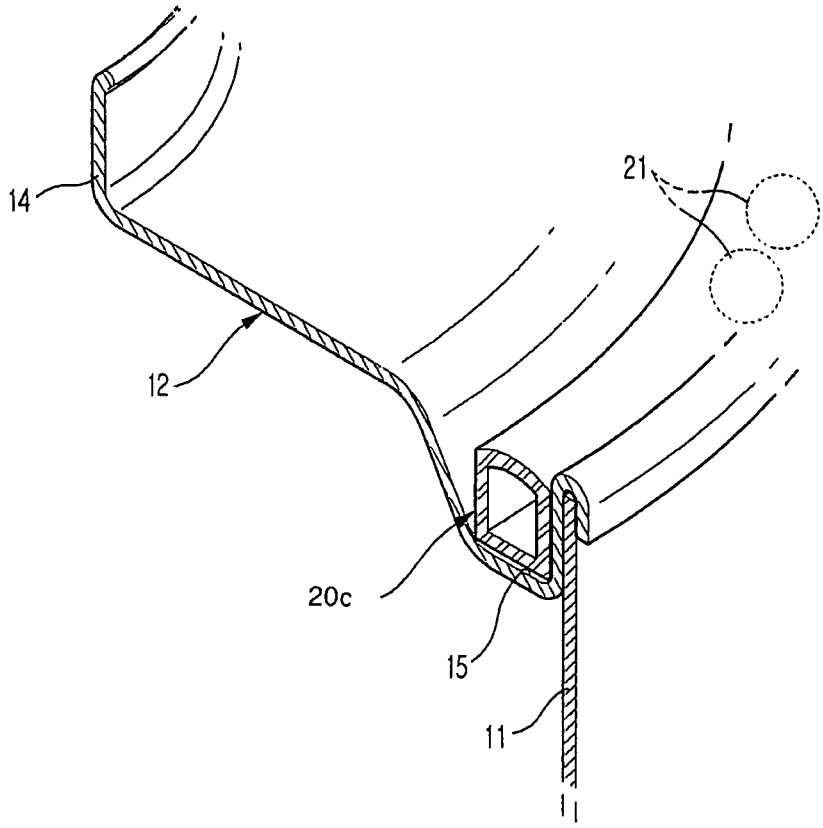
FIG. 5 is a sectional view taken along line A-A of FIG. 2 of the balancer according to the third embodiment of the present invention.
Figure 6:
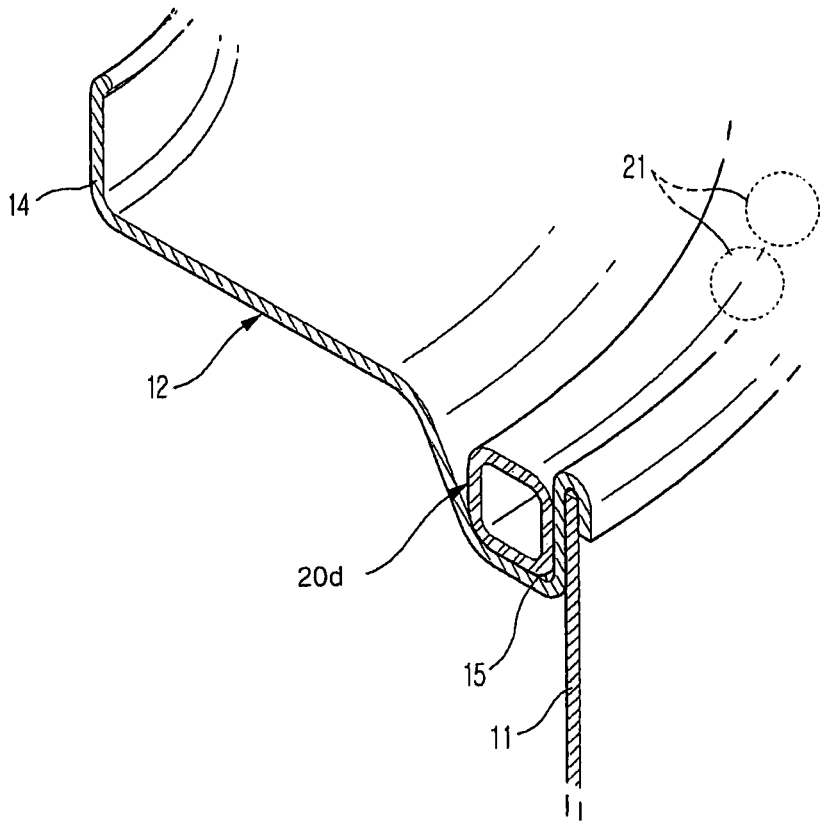
FIG. 6 is a sectional view taken along line A-A of FIG. 2 of the balancer according to the fourth embodiment of the present invention.

FIGS. 3 through 6 are sectional views taken along line A-A of FIG. 2. More specifically, FIG. 3 illustrates an example in which a balancer according to the first embodiment of the present invention has the cross section of a circle, FIG. 4 illustrates an example in which a balancer has the cross section of a square, according to a second embodiment of the present invention, FIG. 5 illustrates an example in which a balancer has the cross section of a square, one side of which is curved, according to a third embodiment of the present invention, and FIG. 6 illustrates an example in which a balancer has the cross section of a square, all corners of which are rounded, according to a fourth embodiment of the present invention.

As illustrated in FIG. 3, a first embodiment of the balancer 20*a* of the present invention is manufactured such that a metal pipe is bent in an annular shape, and then opposite ends of the metal pipe are welded together. Thereby, the balancer 20*a* can have a circular cross section. Due to this circular cross section, the balancer 20 can be rapidly manufactured.

As illustrated in FIG. 4, a second embodiment of the balancer 20*b* of the present invention is manufactured in such a manner that it is manufactured in a manner similar to that of the balancer 20*a* of FIG. 3. However, the second embodiment of the balancer 20*b* is formed to have a quadrilateral cross section. Due to this quadrilateral cross section, the balancer 20*b* can provide a space in which a viscous fluid can flow to corners thereof when the balls 21 move therein, compared to the circular cross section having the same area, so that the balancer 20*b* allows the spin tub 10 to maintain a dynamic balance more rapidly. Further, the balls 21 move in balancer 20*b* in a two-point contact state, so that the balls 21 can make a stable motion.

As illustrated in FIG. 5, a third embodiment of the balancer 20*c* is manufactured to have a quadrilateral cross section, and then at least one side thereof is curved. Thereby, in addition to the advantage of the balancer 20*b* of FIG. 4, the balls 21 can more stably move in the balancer 20*c*.

As illustrated in FIG. 6, a fourth embodiment of the balancer 20*d* is manufactured to have a quadrilateral cross section, similar to that of balancer 20*b* in FIG. 4, and then all corners thereof are rounded. Thereby, the strength of the balancer 20C can be further increased.

Figure 7:
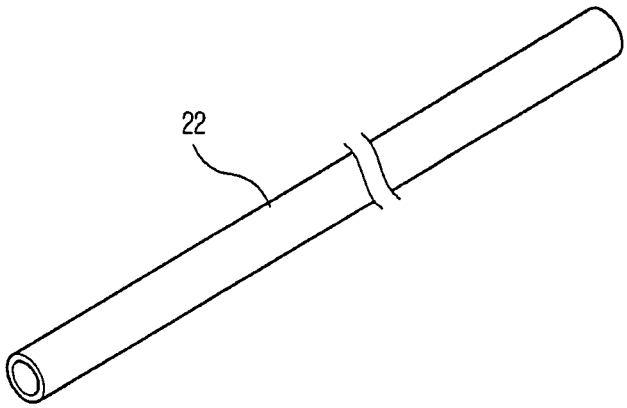
FIG. 7 is a perspective view of a linear metal pipe used as a material for a balancer according to the first embodiment of the present invention

Next, a method of manufacturing a balancer according to the present invention will be described with reference to FIGS. 7 through 12. First, as illustrated in FIG. 7, a linear metal pipe 22 used as material of the balancer 20 of the present invention is prepared. The linear metal pipe 22 is sized to be fitted into and coupled in the recess 15 of the spin tub 10 when bent in an annular shape.

Figure 8:
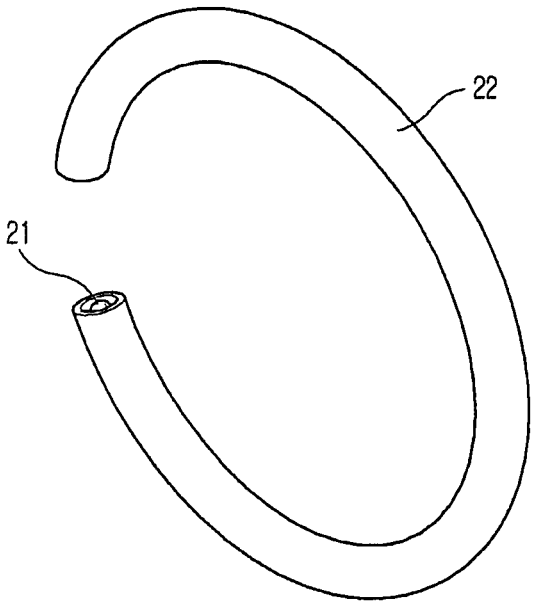
FIG. 8 is a perspective view of the linear pipe according to the first embodiment of the present invention bent into an annular shape.

Next, as illustrated in FIG. 8, the linear metal pipe 22 is bent to have an annular shape, and then is filled with a plurality of balls 21 in a manner similar to that shown in FIG. 2 and a viscous fluid.

Figure 9:
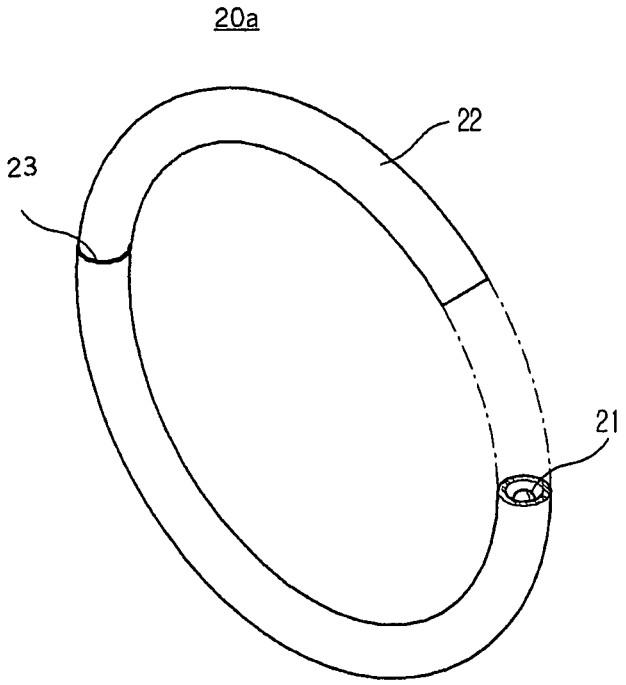
FIG. 9 is a perspective view of the bent linear pipe according to the first embodiment of the present invention welded at opposite ends thereof.

Subsequently, as illustrated in FIG. 9, the bent pipe 22 is welded at opposite ends thereof, so that the balancer 20*a* has a circular cross section. Thereby, the plurality of balls 21 and the viscous fluid are held in the pipe 22 having a circular cross section in an airtight state, so that the balls 21 and fluid can act as the balancer.

Figure 10:
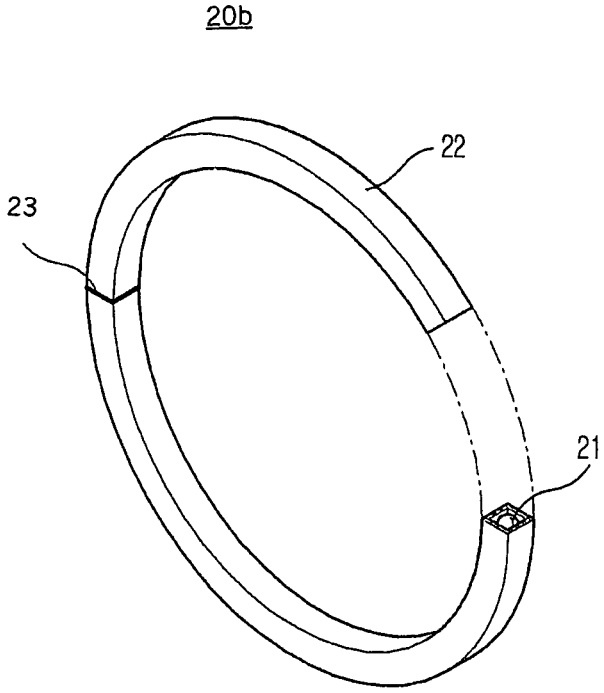
FIG. 10 is a perspective view of the linear pipe according to the second embodiment of the present invention.

As illustrated in FIG. 10, the annular pipe 22 having a circular cross section is pressed to have a quadrilateral cross section, thereby creating the balancer 20*b*. The balancer 20*b* formed to have the quadrilateral cross section can provide a space in which viscous fluid can flow to the corners thereof when the balls 21 move within the pipe 22, compared to the balancer 20*a* having the circular cross section of the same area, so that the spin tub 10 maintains a dynamic balance with rapidity. Further, the balancer 20*b* allows the balls 21 to move within the balancer 20*b* in a two-point contact state, so that the balls 21 make a stable motion.

As described above, the balancer 20*b* is formed to have a quadrilateral cross section. However, the balancer 20*b* having the quadrilateral cross section may be varied in another structure by an additional formation, as illustrated in FIGS. 11 and 12.

Figure 11:
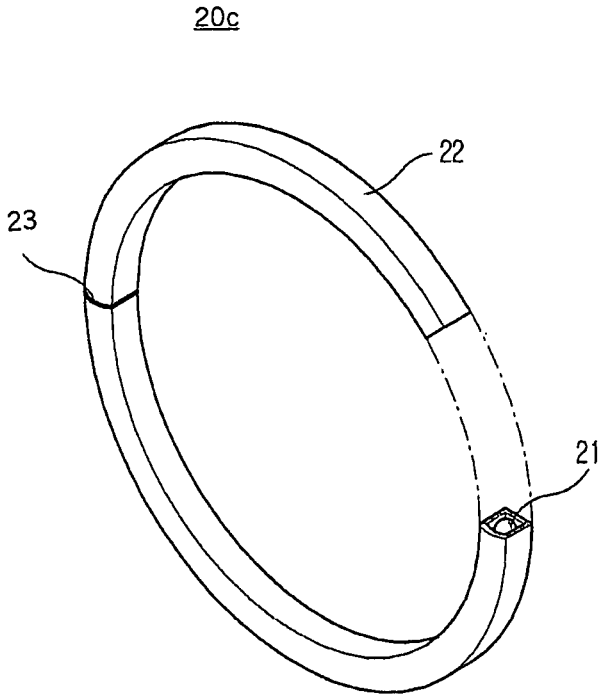
FIG. 11 is a perspective view of the linear pipe according to the third embodiment of the present invention.

More specifically, as illustrated in FIG. 11, the annular pipe 22 having the quadrilateral cross section can be formed such that at least one side thereof is curved. Thereby, the balancer

20*c* provides an advantage in that the balls 21 can more stably move therein, in addition to the advantages of having the quadrilateral cross section.

Figure 12:
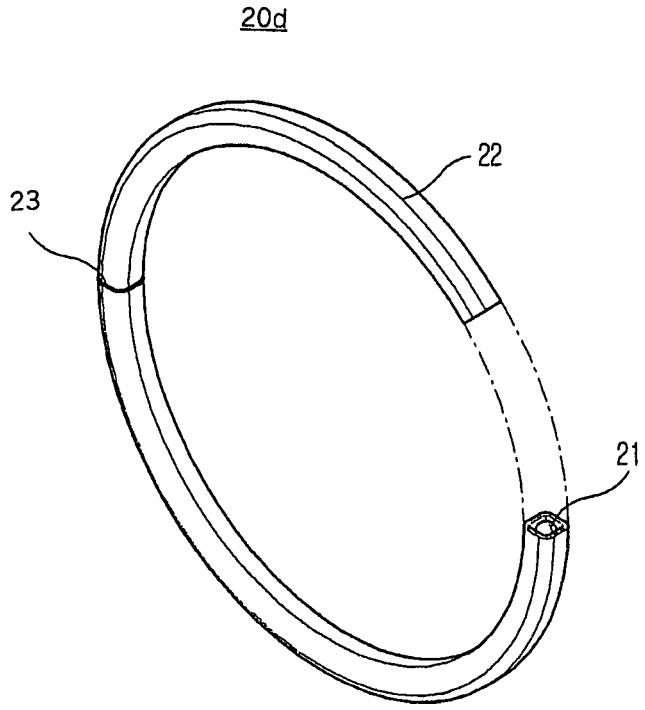
FIG. 12 is a perspective view of the linear pipe according to the fourth embodiment of the present invention.

Further, as illustrated in FIG. 12, the annular pipe 22 having the quadrilateral cross section can be formed such that all corners thereof are rounded. Thereby, the strength of the balancer 20*d* can be further increased.

In the embodiments of the present invention, the balancer has been described to be installed on a drum type washing machine by way of example, but it is apparent that the balancer can be applied to an upright type washing machine having a structure in which a spin tub is vertically installed.

Further, in the embodiments of the present invention, the balancer has mainly been described to have a circular cross section or a quadrilateral cross section, but it is not limited to such a cross section. Therefore, the balancer may have a variety of cross sections, as in polygons.

As described above in detail, the washing machine according to the present invention has a structure in which the balancer manufactured by forming a metal pipe in an annular shape is assembled to the spin tub, so that it can reduce a manufacturing cost and an assembly time to improve its mass productivity. Further, if the balancer is determined to fail after being assembled to the spin tub, the balancer can be rapidly and conveniently replaced with a new one, so that material costs may be reduced.

Further, the washing machine according to the present invention has a weld bead formed only at opposite ends of the bent pipe, so that a height difference between the opposite ends and the weld bead can be reduced to a minimum extent. As a result, the plurality of balls can smoothly move in the balancer, and the noise and vibration caused by the motion of the balls are hardly generated at all.

Although embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A washing machine, comprising:

a housing;

a water reservoir;

a spin tub rotatable by receiving a rotational force from a driving motor through a rotary shaft, the spin tub including a cylindrical body, a front member, a rear member and an annular recess provided along an outer circumferential edge of the front member or the rear member of the spin tub, the annular recess having an inner annular side wall and an outer annular side wall; and a balancer having an annular shaped body placed in the annular recess of the spin tub and including viscous fluid and a plurality of balls disposed and movable within an internal space of the annular shaped body of the balancer, the annular shaped body having a cross section providing an internal quadrilateral space in which the viscous fluid can flow to rounded internal corners of the internal quadrilateral space, wherein the annular recess has a depth greater than a diameter of the balls contained in the ball balancer, whereby during a rotation of the spin tub the balls contained in the ball balancer are supported in a direction of centrifugal force by an outer wall of the annular shaped body, the outer annular side wall of the annular recess and the cylindrical body, the outer wall of the annular shaped body being in contact with the outer annular side wall of the annular recess, and the outer annular side wall of the annular recess being in contact with the cylindrical body to provide a triple wall structure.

2. The washing machine according to claim 1, wherein the annular recess corresponds to the balancer such that the balancer is coupled to the spin tub.

3. The washing machine according to claim 1, wherein the balancer is welded in the annular recess at several points in the recess.

4. The washing machine according to claim 1, wherein balancer includes open ends of a pipe that are welded together.

5. The washing machine according to claim 1, wherein the balancer comprises a plurality of balancers being coupled to the front member and the rear member, wherein the washing machine is a drum type washing machine, and the annular recess includes a plurality of recesses, the recesses being provided at the front and rear members of the spin tub such that the balancers are coupled to opposite ends of the spin tub.

6. The washing machine according to claim 1, wherein one side of the annular shaped body of the balancer is curved.

7. The washing machine according to claim 1, wherein the rounded corners of the annular shaped body of the balancer provide increased strength of the balancer.

8. The washing machine according to claim 1, wherein the balancer is self-contained and separate from the spin tub, the balancer being removably fitted within the annular recess of the spin tub.

9. The washing machine according to claim 1, wherein the balls move within the balancer in a two-point contact state during rotation of the spin tub.

10. A washing machine, comprising:

a spin tub having a cylindrical body, a front member, a rear member and at least one annular recess provided along an outer circumferential edge of the front member or the rear member of the spin tub, the at least one annular recess having an inner annular side wall and an outer annular side wall;

at least one balancer having an annular shaped body and formed separate from the spin tub, the at least one balancer being self-contained and removably fitted within the at least one annular recess to couple the at least one balancer to the spin tub, the annular shaped body of the at least one balancer having a cross section providing an internal quadrilateral space of the annular shaped body with internal rounded corners; and a plurality of balls disposed within the internal quadrilateral space of the annular shaped body, wherein the at least one annular recess has a predefined depth such that the outer annular side wall of the annular recess establishes direct physical contact with a predefined circumferential area of an inner surface of the cylindrical body to provide a double wall structure, and wherein the at least one annular recess has a depth greater than a diameter of the balls contained in the ball balancer, whereby during a rotation of the spin tub the balls contained in the ball balancer are supported in a direction of centrifugal force by an outer wall of the annular shaped body, the outer annular side wall of the at least one annular recess and the cylindrical body, the outer wall of the annular shaped body being in contact with the outer annular side wall of the at least one annular recess, and the outer annular side wall of the at least one annular recess being in contact with the cylindrical body to provide a triple wall structure.

11. The washing machine according to claim 10, wherein the plurality of balls move within the at least one balancer in a two-point contact state.

12. The washing machine according to claim 11, further comprising viscous fluid disposed within the at least one balancer, the viscous fluid flowing to corners thereof when the balls move therein.

13. The washing machine according to claim 10, wherein at least one side defining the internal quadrilateral space of the annular shaped body of the balancer is curved.

* * * * *